US009797248B2

(12) United States Patent
He et al.

(10) Patent No.: US 9,797,248 B2
(45) Date of Patent: Oct. 24, 2017

(54) CONSTANT-RESISTANCE AND LARGE DEFORMATION ANCHOR CABLE AND CONSTANT-RESISTANCE DEVICE

(75) Inventors: Manchao He, Beijing (CN); Zhigang Tao, Beijing (CN); Bin Zhang, Beijing (CN); Xiaojie Yang, Beijing (CN)

(73) Assignee: China University of Mining & Technology (Beijing), Beijing (CN)

( * ) Notice: Subject to any disclaimer, the term of this patent is extended or adjusted under 35 U.S.C. 154(b) by 797 days.

(21) Appl. No.: 14/126,289

(22) PCT Filed: Jun. 13, 2011

(86) PCT No.: PCT/CN2011/075640
§ 371 (c)(1),
(2), (4) Date: Apr. 17, 2014

(87) PCT Pub. No.: WO2012/171155
PCT Pub. Date: Dec. 20, 2012

(65) Prior Publication Data
US 2014/0227042 A1 Aug. 14, 2014

(51) Int. Cl.
*E21D 21/00* (2006.01)
*E21D 20/02* (2006.01)
(Continued)

(52) U.S. Cl.
CPC ..... *E21D 21/0033* (2013.01); *E02D 5/80* (2013.01); *E21D 21/02* (2013.01)

(58) Field of Classification Search
CPC ..... E21D 20/028; E21D 2021/006; E21D 20/025; E21D 20/02; E21D 20/021
(Continued)

(56) References Cited

U.S. PATENT DOCUMENTS 3,391,543 A * 7/1968 Sweeney ..... E21B 7/046 166/155
3,877,235 A * 4/1975 Hill ..... E21D 20/025 405/259.2
(Continued)

FOREIGN PATENT DOCUMENTS

CN 88220725.3 U 3/1989
CN 2044285 9/1989
(Continued)

OTHER PUBLICATIONS

International Search Report from PCT/CN2011/075640 Sep. 1, 2011.
(Continued)

*Primary Examiner* — Benjamin Fiorello
*Assistant Examiner* — Edwin Toledo-Duran
(74) *Attorney, Agent, or Firm* — Calfee Halter & Griswold LLP

(57) ABSTRACT

A constant-resistance and large deformation anchor cable and a constant-resistance device are provided. The constant-resistance and large deformation anchor cable comprises cables (7), an anchoring device (13), a loading plate (12) and clipping sheets (4). The upper end of cables (7) is fixed on the anchoring device (13) and the loading plate (12) by clipping sheets (4). The constant-resistance and large deformation anchor cable also comprises a constant-resistance device, and the constant-resistance device comprises a sleeve (8) and a constant-resistance body (5). The sleeve (8) is a straight tube. The constant-resistance body is conical, and the diameter of the lower end of the constant-resistance body is bigger than the diameter of the upper end of the constant-resistance body. The inner diameter of the sleeve (8) is smaller than the diameter of the lower end of the constant-resistance body. A cuneiform part is arranged on inner wall of the lower end of the sleeve (8), and the
(Continued)

constant-resistance body (5) is arranged on the cuneiform part. The strength of constant-resistance body (5) is higher than the strength of the sleeve (8), thus the sleeve (8) generates plastic deforming and the shape of the constant-resistance body (5) is not changed, when the constant-resistance body (5) moves in the sleeve (8). The lower end of the cables (7) is fixed on the constant-resistance body (5). The constant-resistance and large deformation anchor cable and the constant-resistance device have the properties of constant-resistance and preventing fracture, and can detect and early warn the all process of the activity of the landslides and the causative fault.

12 Claims, 4 Drawing Sheets

(51) Int. Cl.
*E02D 5/80* (2006.01)
*E21D 21/02* (2006.01)

(58) Field of Classification Search
USPC ..... 405/259.1, 259.2, 259.3, 259.4, 259.6, 405/262
See application file for complete search history.

(56) References Cited

U.S. PATENT DOCUMENTS 3,973,409 A * 8/1976 Asayama ..... E02D 5/74 175/292
4,000,623 A 1/1977 Meardi
4,062,229 A * 12/1977 Godfrey ..... G01H 13/00 73/582
4,100,748 A * 7/1978 Hansen ..... E21D 21/008 405/259.3
4,306,397 A * 12/1981 Ramseyer ..... G21C 19/07 250/506.1
4,313,628 A * 2/1982 Duenke ..... F16L 31/00 285/115
4,347,020 A * 8/1982 White ..... E21D 20/025 405/259.1
4,378,180 A 3/1983 Scott
4,516,886 A * 5/1985 Wright ..... E21D 20/025 405/259.3
4,605,338 A * 8/1986 Peterson ..... E01F 5/005 138/105
4,678,374 A * 7/1987 Calandra, Jr. ..... E21D 21/008 405/259.6
4,861,197 A * 8/1989 Calandra, Jr. ..... E21D 21/008 405/259.3
5,049,015 A * 9/1991 Sawaide ..... E04B 1/4164 411/386
6,564,524 B1 * 5/2003 Gruita ..... E04B 2/44 52/311.1
6,742,966 B2 * 6/2004 Cook ..... E21D 21/008 405/259.3
8,087,850 B2 * 1/2012 Craig ..... E21D 21/0046 405/259.1
8,240,958 B2 * 8/2012 Eigemann ..... E21D 21/004 405/259.1
8,517,641 B2 * 8/2013 Dubon ..... F16B 13/144 405/259.6
8,635,832 B2 * 1/2014 Heudorfer ..... E04B 1/4107 52/704
2006/0027797 A1 * 2/2006 Sicking ..... E01F 9/635 256/13.1
2006/0038164 A1 * 2/2006 Sicking ..... E01F 9/635 256/13.1
2007/0031196 A1 * 2/2007 Bruneau ..... E21D 21/0026 405/259.4
2012/0163924 A1 * 6/2012 Rataj ..... E21D 21/0033 405/259.3
2013/0298687 A1 * 11/2013 Eckstein ..... F16B 13/065 73/761

FOREIGN PATENT DOCUMENTS

CN 2740664 Y 11/2005
CN 201372432 12/2009
CN 101858225 10/2010
CN 201753609 3/2011
DE 4408043 A1 9/1995
GB 2022756 12/1979
JP 54-159553 A 12/1979
JP 59-130077 A 7/1984
JP 62-193705 A 8/1987
JP 2000-160558 A 6/2000
JP 2001 032273 A 2/2001
KR 2009 0127841 A 12/2009
KR 2010 0054354 A 5/2010

OTHER PUBLICATIONS

Supplementary European Search Report from EP Application No. 11867912.5 dated Nov. 18, 2015.
Japanese Office Action from application No. JP 2014-515020 dated Nov. 25, 2014.
Communication Pursuant to Article 94(3) EPC dated Jun. 30, 2016 (5 pages).

* cited by examiner

CONSTANT-RESISTANCE AND LARGE DEFORMATION ANCHOR CABLE AND CONSTANT-RESISTANCE DEVICE

CROSS-REFERENCE TO RELATED APPLICATION

This application is the U.S. national phase entry of PCT/CN2011/075640, with an international filing date of 13 Jun. 2011, the entire disclosure of which is fully incorporated herein by reference.

TECHNICAL FIELD

The disclosure relates to new material for monitoring and early warning the soft rock slope stableness and monitoring the activity of seismogenic fault, more particularly, to a constant-resistance and large deformation anchor cable and the constant-resistance device thereof, which belong to the area of reinforcing, monitoring and early warning the large deformation of the soft rock slope.

BACKGROUND ART

After the 1950s, with the improvement of pre-stress technology, the gradually perfection of anchor reinforce theory, designing method, regulations and standards, as well as the continually progress of anchor cable anti-corrosion means, a pre-stress anchor cable is progressed faster and faster. Currently, the bearing pre-stress of a single pre-stress anchor cable of rock reaches 16MN (in German). The pre-stress anchor cable is various in structures and types, and is improving and perfecting continually along with the utilization level. Pre-stress anchoring technology is widely used in various areas of rock geotechnical reinforcement engineering, and rich engineering practice experience has been accumulated.

However, in the area of monitoring and early warning soft rock slope and activity fault, it is found that using a conventional pre-stress anchor cable as a mechanical transmission device may have weak. For example, when the sliding force on the slide plane and fault plane exceeds the material strength of the anchor cable, the anchor cable may fracture, so that the mechanical signal transmission system may be broken, and the whole monitoring system may fail, as a result, it is incapable to monitor the whole landslip process continuously.

SUMMARY OF THE INVENTION

An objective of the disclosure is to provide a constant-resistance and large deformation anchor cable and the constant-resistance device thereof, to solve the problem in the conventional anchor cable that the anchor cable may fail due to only relying on the anchor cable strength when the sliding force exceeds the material strength of the pre-stress anchor cable.

To achieve the objective above, the disclosure provides a constant-resistance device of a constant-resistance and large deformation anchor cable including a sleeve and a constant-resistance body for fixedly connecting a cable, the sleeve is straight pipe structure, the constant-resistance body has frustum structure, and the diameter of a lower end face of the constant-resistance body is larger than the diameter of an upper end face of the constant-resistance body; the inner diameter of the sleeve is smaller than the diameter of the lower end face of the constant-resistance body, a cuneiform portion is disposed at a lower portion of an inner wall of the sleeve, the constant-resistance body is disposed at the cuneiform portion; the strength of the constant-resistance body is higher than the strength of the sleeve, so as to make the constant-resistance body have no deformation and make the sleeve have plastic deformation to generate constant resistance when the constant-resistance body moves in the sleeve.

According to a preferred embodiment of the constant-resistance device of the constant-resistance and large deformation anchor cable in an embodiment of the disclosure, a plurality of through holes are disposed in the constant-resistance body, the through holes have frustum structure, and the axes of the through holes are parallel with the axis of the constant-resistance body.

To achieve the objective above, the disclosure provides a constant-resistance and large deformation anchor cable including cables, an anchoring device, a loading plate and clamping sheets, upper ends of the cables being fixed to the anchoring device and the loading plate via the clamping sheets, wherein the constant-resistance and large deformation anchor cable further includes a constant-resistance device, the constant-resistance device includes a sleeve and a constant-resistance body, the sleeve has a straight pipe structure, and the constant-resistance body has a frustum structure, the diameter of a lower end face of the constant-resistance body is larger than the diameter of the upper end face of the constant-resistance body; the inner diameter of the sleeve is smaller than the diameter of the lower end face of the constant-resistance body, a cuneiform portion is disposed at a lower portion of the inner wall of the sleeve, the constant-resistance body is disposed at the cuneiform portion; the strength of the constant-resistance body is higher than the strength of the sleeve, so as to make the constant-resistance body have no deformation and make the sleeve have plastic deformation to generate constant resistance when the constant-resistance body moves in the sleeve; lower ends of the cables are fixed to the constant-resistance body.

According to a preferred embodiment of the constant-resistance and large deformation anchor cable in an embodiment of the disclosure, the constant-resistance body comprises a plurality of through holes, the through holes have frustum structures, and the axes of the through holes are parallel with the axis of the constant-resistance body; the lower ends of the cables are fixed in the through hole via the clamping sheets.

According to a preferred embodiment of the constant-resistance and large deformation anchor cable in an embodiment of the disclosure, a skid-resistance baffle is fixed to the upper end of the sleeve, and the cables pass through the skid-resistance baffle.

According to a preferred embodiment of the constant-resistance and large deformation anchor cable in an embodiment of the disclosure, a partition board is fixed to an upper portion of the inner wall of the sleeve, the cables pass through the partition board, and water-proof and anti-corrosion material is filled in the sleeve above the partition board.

According to a preferred embodiment of the constant-resistance and large deformation anchor cable in an embodiment of the disclosure, a baffle covers the lower end face of the constant-resistance body to prevent the clamping sheets in the through hole from falling off.

According to a preferred embodiment of the constant-resistance and large deformation anchor cable in an embodiment of the disclosure, a plurality of first type holes are disposed at the baffle, the lower end of the cables pass the first type holes on the baffle.

According to a preferred embodiment of the constant-resistance and large deformation anchor cable in an embodiment of the disclosure, a sealing guiding head is disposed at the lower end of the sleeve.

According to a preferred embodiment of the constant-resistance and large deformation anchor cable in an embodiment of the disclosure, a second type hole is disposed at the center of the baffle, a screw passes through the second type hole to fix the baffle to the lower end face of the constant-resistance body.

According to a preferred embodiment of the constant-resistance and large deformation anchor cable in an embodiment of the disclosure, a mechanical sensor is disposed at the upper ends of the cables to detect the force condition of the cables, and the mechanical sensor is disposed between the anchoring device and the loading plate.

According to a preferred embodiment of the constant-resistance and large deformation anchor cable in an embodiment of the disclosure, the upper end face of the guiding head comprises a recess.

According to a preferred embodiment of the constant-resistance and large deformation anchor cable in an embodiment of the disclosure, the water-proof and anti-corrosion material is mixed material of paraffin, asphalt and grease.

According to a preferred embodiment of the constant-resistance and large deformation anchor cable in an embodiment of the disclosure, the front end of the guiding head has a shape of cone or frustum with a flat head.

In the constant-resistance and large deformation anchor cable adapted to monitoring soft rock slope and seismogenic fault activity, seen from the landslip disaster monitoring and seismogenic fault activity monitoring, the anchor cable does not fracture or lose the monitoring effect due to the sliding force being higher than the ultimate strength of the anchor cable during the rock slide process. Instead, the constant-resistance body slides in the sleeve to resist the fracture of the remained sliding force. The device has rational construction, is convenient in usage, has the mechanical characteristic of both resisting performance and sliding performance, and has constant resistance to prevent fracture, which may monitor and early warn the whole process of the landslip hazard and the seismogenic fault activity.

DETAILED DESCRIPTION OF THE PREFERRED EMBODIMENTS

Hereinafter, the embodiments are described along with the accompanying drawing.

In view of the drawback and problem of the conventional technology, based on the control theory of constant-resistance and large deformation and basic theory of anchoring system, the disclosure discloses a constant-resistance and large deformation anchor cable which is used in reinforcing, monitoring, early warning of soft rock slope and seismogenic fault, when the load applied on the anchor cable exceeds a designed threshold value, the constant-resistance device disposed at the lower end of the anchor cable and formed by the constant-resistance body and the sleeve may resist the fracture generated by the remaining load by sliding the constant-resistance body in the sleeve.

Figure 1:
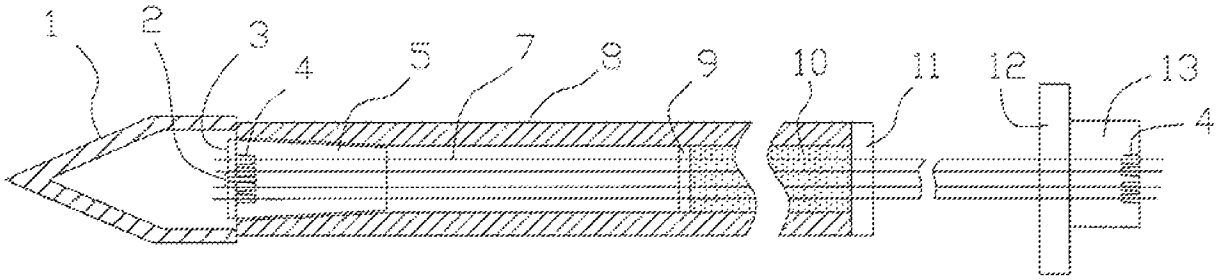
FIG. 1 is a sectional view diagram of a constant-resistance and large deformation anchor cable in a preferred embodiment of the disclosure.
Figure 7:
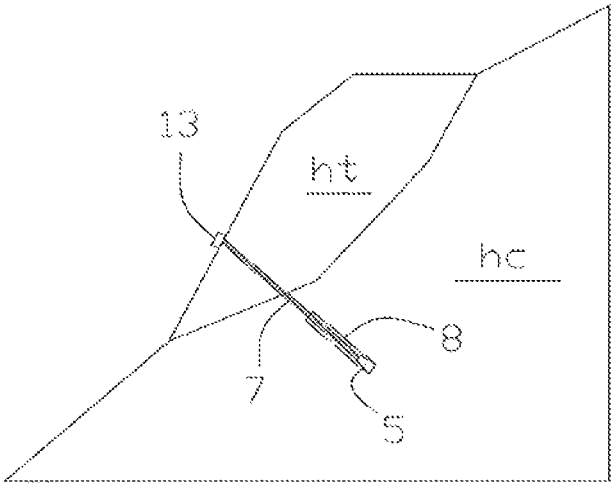
FIG. 7 is a perspective view diagram of the constant-resistance and large deformation anchor cable in a preferred embodiment of the disclosure used in a geological structure before landslip.
Figure 8:
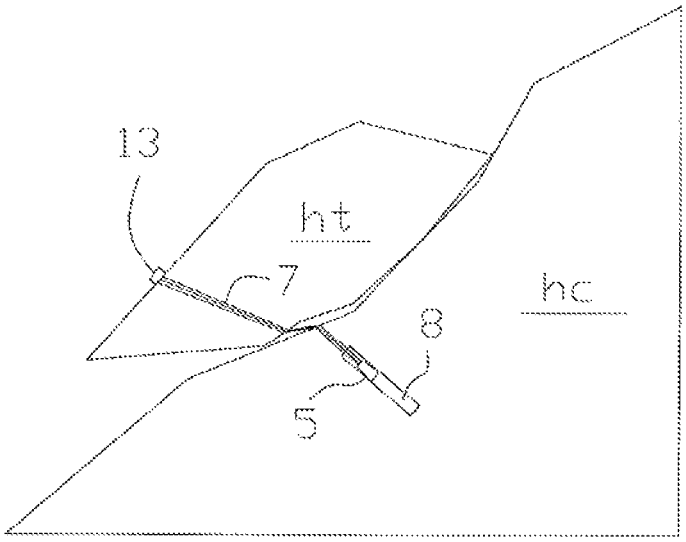
FIG. 8 is a perspective view diagram of the constant-resistance and large deformation anchor cable in a preferred embodiment of the disclosure used in a geological structure after landslip

FIG. 1 shows the structure of the constant-resistance and large deformation anchor cable in a preferred embodiment of the disclosure. As shown in FIG. 1, in the embodiment, the constant-resistance and large deformation anchor cable includes a guiding head 1, a constant-resistance body 5, a sleeve 8, cables 7, a partition board 9, a skid-resistance baffle 11, water-proof material 10 filled between the partition board 9 and the skid-resistance baffle 11, a loading plate 12, an anchoring device 13 and clamping sheets 4 for fixing the cables 7 to the anchoring device 13 and the constant-resistance body 5. During utilizing, as shown in FIG. 7 and FIG. 8, upper ends of the cables 7 are fixed to the anchoring device 13 via the clamping sheets 4, and the loading plate 12 abuts against an anchorage pier which is additionally disposed.

Figure 2:
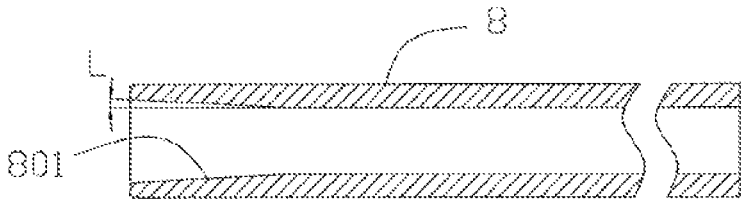
FIG. 2 is a sectional view diagram of the sleeve of the constant-resistance and large deformation anchor cable in a preferred embodiment of the disclosure.
Figure 3:
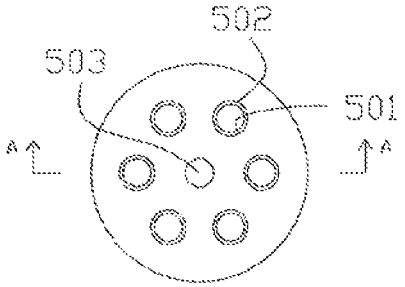
FIG. 3 is a bottom view diagram of the constant-resistance body of the constant-resistance and large deformation anchor cable in a preferred embodiment of the disclosure.
Figure 4:
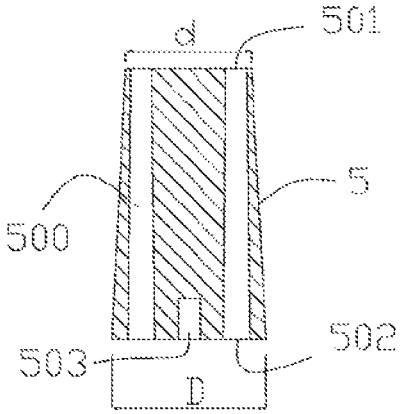
FIG. 4 is a sectional view diagram taken along A-A line in FIG. 3.

As shown in FIG. 1 and FIG. 2, the sleeve 8 in the preferred embodiment has a straight pipe structure, the lower portion of the inner wall has a cuneiform portion 801 for accommodating the constant-resistance body 5, and the slide surface of the cuneiform portion 801 and the inner wall of the sleeve 8 form a small angle L. As shown in FIG. 1, FIG. 3 and FIG. 4, the constant-resistance body 5 in the embodiment has frustum structure, and the diameter D of the lower end face of the constant-resistance body 5 is larger than the diameter d of the upper end face of the constant-resistance body 5. The inner diameter of the sleeve 8 is smaller than the diameter D of the lower end face of the constant-resistance body 5. The strength of the constant-resistance body 5 is higher than the strength of the sleeve 8. For example, the constant-resistance body 5 is 45th carbon steel, and the sleeve 8 may be 20th carbon steel. The materials of the constant-resistance body 5 and the sleeve 8, the angle between the side wall and the lower end face of the constant-resistance body 5, the length of the constant-resistance body 5, the diameter d of the upper end face of the constant-resistance body 5 and the diameter D of the lower end face of the constant-resistance body 5, the thickness of the side wall of the sleeve 8, the difference between the diameter D of the lower end face of the constant-resistance body 5 and the inner diameter of the sleeve 8 are all related to the friction force generated when the constant-resistance body 5 slides in the sleeve 8, and the detailed choice may vary according to the requirement. That is because, during practical process, when the slope slides downwardly, as shown in FIG. 7 and FIG. 8, the cables 7 drive the constant-resistance body 5 to slide in the sleeve, the sliding friction force is used to ensure the constant-resistance effect of the constant-resistance and large deformation anchor cable in the preferred embodiment. However, the parameters of the constant-resistance body 5 and the sleeve 8 should be chosen to allow the shape of the constant-resistance body 5 not to deform and to allow the sleeve 8 to have plastic deformation when the constant-resistance body 5 moves in the sleeve 8. For example, when the constant-resistance body 5 is 45th carbon steel, the diameter of the upper end face of the constant-resistance body 5 is 93 mm, the diameter of the lower end face of the constant-resistance body 5 is 96 mm, the length of the constant-resistance body 5 is 150 mm, the sleeve 8 is 20th carbon steel, the inner diameter of the sleeve 8 is 93 mm, the thickness of the wall of the sleeve 8 is 20 mm, the constant resistance between the constant-resistance body 5 and the sleeve 8 is 850 KN.

To fasten the cables 7 to the constant-resistance body 5 conveniently and efficiently, the constant-resistance body 5 in the preferred embodiment includes a plurality of through holes 500 to allow a plurality of cables 7 to pass through and to accommodate the clamping sheets 4. As shown in FIG. 3 and FIG. 4, upper end openings 501 of the through holes 500 are located at the upper end face of the constant-resistance body 5, lower end openings 502 of the through holes 500 are located at the lower end face of the constant-resistance body 5, the upper end openings 501 are smaller than the lower end openings 502. Seen from the FIGs, the through holes 500 have frustum structure. The axis of each through hole 500 is parallel with the axis of the constant-resistance body 5, and the lower end of each cable 7 is fixed in the through hole 500 via the clamping sheet 4. It should be noted that, in the embodiment, there are 6 cables and 6 through holes 500 of the constant-resistance body 5 corresponding to the 6 cables, and the through holes 500 are around the axis of the constant-resistance body 5 and are averagely disposed in the constant-resistance body 5, which is taken as an example, the disclosure is not limited thereto. The amount of cables and the disposing method of the through holes may be changed according to requirements.

To prevent the constant-resistance body 5 from sliding out of the sleeve 8 due to material defect or manufacturing defect, or the constant-resistance body 5 slides out of the sleeve 8 normally, a skid-resistance baffle 11 is fixed to an upper end of the sleeve 8 by means of welding, for example. The skid-resistance baffle 11 is provided with holes for passing the cables. Preferably, the axes of the holes and the axes of the through holes 500 of the constant-resistance body 5 are in the same line.

Figure 5:
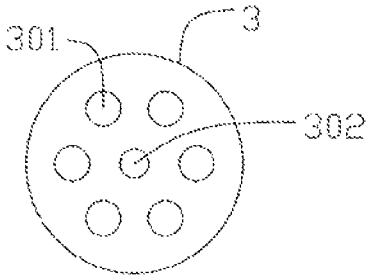
FIG. 5 is a perspective view diagram of the baffle of the constant-resistance and large deformation anchor cable in a preferred embodiment of the disclosure.

Before applying the anchor cable to the soft rock in the application field, the cables 7 is fixed to the lower ends of the through holes 500 of the constant-resistance body 5 via the clamping sheets 4. During applying the anchor cable, the cables 7 may have forth-and-back slide to make the clamping sheets 4 fall off. To prevent the falling off of the clamping sheets 4, as shown in FIG. 1 and FIG. 5, a baffle 3 covers the lower end face of the constant-resistance body 5. The center of the baffle 3 is disposed with a hole 302, and a screw 2 passes through the hole 302 and is fixed to the hole 503 at the lower end face of the constant-resistance body 5, thereby fixing the baffle 3 to the lower end face of the constant-resistance body 5. A plurality of holes 301 are disposed at the periphery of the baffle 3, and the holes 301 and cables 7 are corresponding to each other, the lower ends of the cables 7 pass through the holes 301 respectively, thereby preventing the cables 7 from being incapable of fixing in the through holes 500 due to looseness of the clamping sheets 4 and the over-small allowance of the cables 7.

Figure 6:
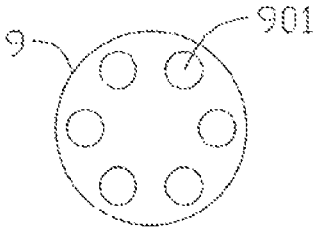
FIG. 6 is a perspective view diagram of the partition board of the constant-resistance and large deformation anchor cable in a preferred embodiment of the disclosure.

To prevent slurry or underground water from entering the sleeve 8 and corrode the inner wall of the constant-resistance body 5 and the sleeve 8 which may cause unable to achieve the constant-resistance during fixing the constant-resistance and large deformation anchor cable, a partition board 9 is fixed in the inner wall of the sleeve 8 in the preferred embodiment. As shown in FIG. 1 and FIG. 6, the cables 7 pass through the holes 901 of the partition board 9, waterproof and anti-corrosion material is filled in the space formed by the partition board 9, the skid-resistance baffle 11 and the inner walls of the sleeve. The anti-corrosion material may be paraffin, asphalt, grease, or mixed by paraffin, asphalt and grease with certain ratio. Preferably, an axis of the hole 901 which is disposed at the partition board 9 and used for the cables 7 to pass through is co-axial with the axis of the through hole 500 in the constant-resistance body 5.

To prevent corrosion of the sleeve 8 and the constant-resistance body 5, the lower end of the sleeve 8 in the embodiment is provided with a sealing guiding head 1. Preferably, the front end of the guiding head 1 is cone-shaped, and it may also be a frustum with flat head. A recess is disposed at the upper end, and the cone structure is benefit for reducing resistance during applying anchoring device. The recess may be used to reduce weight, simplify structure and accommodate the cables 7 extending out of the baffle 2.

To obtain the tensile force of the cables 7, a mechanical sensor (not shown in the drawings) is disposed between the loading plate 12 and the anchoring device 13 at the upper ends of the cables 7.

As shown in FIG. 7, before landslip, the constant-resistance and large deformation anchor cable in the preferred embodiment of the disclosure is used to pass through the potential sliding surface ht and is placed in a relative stable slip bed hc. As shown in FIG. 8, during the landslip process, when the sliding force is less than the designed constant resistance (the static friction force between the constant-resistance body 5 and the sleeve 8), it is the cables 7 that are mainly used to resist the increment of the sliding force. When the sliding force is higher than the designed constant resistance in the embodiment, the constant-resistance body 5 slides along the sleeve 8, the structural formation of the sleeve 8 is used to resist the increment of the sliding force, thereby preventing the anchor cable to be fractured due to the larger deformation of the rock-soil mass.

Figure 9:
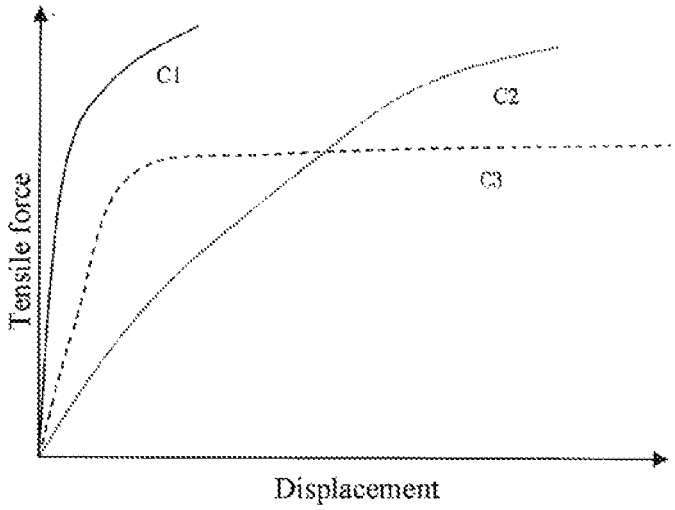
FIG. 9 is a displacement-tensile force curve when using the preferred embodiment of the disclosure.

When the larger deformation of the rock-soil mass is generated, the deformation energy may be applied to the cables 7 to turn to the axial tensile force of the cables 7. When the axial tensile force is less than the cable designed constant resistance, due to the friction force, no displacement is generated between the constant-resistance body 5 and the sleeve 8. The force sensed by the mechanical sensor is an axial tensile force on the cables 7 in its elastic range. When the axial tensile force of the cable 7 is higher than or equal to the design constant resistance of the cable 7, the constant-resistance body 5 begins to slide long the sleeve 8, and the force sensed by the mechanical sensor is mainly the constant resistance. Since the constant resistance is a friction resistance between the sleeve 8 and the constant-resistance body 5, during sliding process, under the condition that the inner defect of the sleeve 8 is not considered, the constant resistance is stable, the mechanical information sensed by the mechanical sensor is stable too. The collected data can be drawn as the tensile force-displacement curve in FIG. 9, in which the curve c1 is a tensile force-displacement curve of a conventional pre-stress anchor cable, c2 is a tensile force-displacement curve of a conventional non-pre-stress anchor cable, and c3 is a tensile force-displacement curve of the embodiment. Via the curves, the energy that resist the deformation and the energy that can absorb the deformation in the embodiment can be calculated. The mechanical sensor may also be used to collect mechanical information of the conventional pre-stress anchor cable. Since it does not have constant-resistance performance, the energy absorbing characteristic does not exist, the landslip process cannot be calculated scientifically. Even though the landslip is generated, the deformation energy and sliding force are not obtained.

To sum up, by utilizing the disclosure, when the sliding rock turns from a stable state to a non-stable state, from a near-sliding state to a critical sliding state, the sliding force applied to the rock increases continuously. When the sliding force exceeds the designed constant resistance, the constant-resistance body slides to resist the fracture of the anchor cable generated by the large deformation of the rock-soil mass. Seen from the landslip disaster monitoring and seismogenic fault activity monitoring, the anchor cable does not fracture or lose the monitoring effect due to the sliding force being higher than the ultimate strength of the anchor cable during the rock slide process. Instead, the constant-resistance body slides in the sleeve to resist the fracture of the remained sliding force. The device has rational construction is convenient in usage, has the mechanical characteristic of both resisting performance and sliding performance, and has constant resistance to prevent fracture, which may monitor and early warn the whole process of the landslip hazard and the seismogenic fault activity.

Although the disclosure has been described as above in reference to several typical embodiments, it is to be understood that the terms used therein are just illustrative and exemplary rather than restrictive. Since the disclosure can be applied in various forms without departing from the spirit or principle of the disclosure, it is to be understood that the abovementioned embodiments will not be limited to any specific details mentioned above, rather, they should be construed broadly in the spirit or concept of the disclosure defined by the appended claims. Therefore, the present disclosure aims to cover all the modifications or variations falling within the protection scope defined by the appended claims.

What is claimed is:

1. A resistance device of an anchor cable, comprising a sleeve, and a resistance body for fixedly connecting the anchor cable, wherein the sleeve has a straight pipe structure, the resistance body has a frustum structure, and a diameter of a lower end face of the resistance body is larger than a diameter of an upper end face of the resistance body;

the sleeve has an inner diameter smaller than the diameter of the lower end face of the resistance body, a tapered portion is disposed at a lower portion of an inner wall of the sleeve, the resistance body is disposed at the tapered portion;

the resistance body has a strength higher than that of the sleeve, so as to make the resistance body have no deformation and make the sleeve have plastic deformation to generate a constant friction resistance between the sleeve and the resistance body when the resistance body moves in the sleeve, wherein a partition board is fixed to an upper portion of the inner wall of the sleeve, cables pass through the partition board, and water-proof and anti-corrosion material is filled in the sleeve above the partition board, wherein a sealing guiding head is disposed at a lower end of the sleeve, an outer diameter of a rear end of the sealing guiding head is larger than an outer diameter of the sleeve, an inner diameter of the rear end of the sealing guiding head larger than the inner diameter of the sleeve, and an inner diameter of the rear end of the sealing guiding head is smaller than the outer diameter of the sleeve, the partition board prevents water, slurry, or the water-proof and anti-corrosion material from entering a space formed by the sealing guiding head, the sleeve, and the partition board.

2. The resistance device of the anchor cable according to claim 1, wherein a plurality of through holes are disposed in the resistance body, and have frustum structures, and axes of the through holes are parallel with an axis of the resistance body.

3. A anchor cable comprising cables, an anchoring device, a loading plate and clamping sheets, upper ends of the cables being fixed to the anchoring device and the loading plate by the clamping sheets, wherein the anchor cable further comprises a resistance device, the resistance device comprises a sleeve and a resistance body, the sleeve has a straight pipe structure, and the resistance body has a frustum structure, a diameter of a lower end face of the resistance body is larger than a diameter of the upper end face of the resistance body; the sleeve has an inner diameter smaller than the diameter of the lower end face of the resistance body, a tapered portion is arranged at a lower portion of an inner wall of the sleeve, the resistance body is disposed at the tapered portion;

the resistance body has a strength higher that of the sleeve, so as to make the resistance body have no deformation and make the sleeve have plastic deformation to generate a constant friction resistance between the sleeve and the resistance body when the resistance body moves in the sleeve;

lower ends of the cables are fixed to the resistance body, wherein a partition board is fixed to an upper portion of an inner wall of the sleeve, the cables pass through the partition board, and water-proof and anti-corrosion material is filled in the sleeve above the partition board, wherein a sealing guiding head is disposed at a lower end of the sleeve, an outer diameter of a rear end of the sealing guiding head is larger than an outer diameter of the sleeve, an inner diameter of the rear end of the sealing guiding head larger than the inner diameter of the sleeve, and an inner diameter of the rear end of the sealing guiding head is smaller than the outer diameter of the sleeve, the partition board prevents water, slurry, or the water-proof and anti-corrosion material from entering a space formed by the sealing guiding head, the sleeve, and the partition board.

4. The anchor cable according to claim 3, wherein the resistance body comprises a plurality of through holes, the through holes have frustum structures, and axes of the through holes are parallel with an axis of the resistance body;

the lower ends of the cables are fixed in the through holes via the clamping sheets.

5. The anchor cable according to claim 3, wherein a skid-resistance baffle is fixed to an upper end of the sleeve, and the cables pass through the skid-resistance baffle.

6. The anchor cable according to claim 4, wherein a baffle covers the lower end face of the resistance body to prevent the clamping sheets in the through hole from falling off.

7. The anchor cable according to claim 6, wherein a plurality of first type holes are disposed on the baffle, the lower ends of the cables pass the first type holes on the baffle.

8. The anchor cable according to claim 6, wherein a second type hole is disposed at a center of the baffle, a screw passes through the second type hole to fix the baffle to the lower end face of the resistance body.

9. The anchor cable according to claim 3, wherein a mechanical sensor is disposed at the upper ends of the cables to detect the force condition of the cables, and the mechanical sensor is also disposed between the anchoring device and the loading plate.

10. The anchor cable according to claim 3, wherein an upper end face of the sealing guiding head comprises a recess.

11. The anchor cable according to claim 3, wherein the water-proof and anti-corrosion material is mixed material of paraffin, asphalt and grease.

12. The anchor cable according to claim 3, wherein a front end of the sealing guiding head has a shape of cone or frustum with a flat head.

* * * * *